US010869807B2

(12) United States Patent
Nelson

(10) Patent No.: US 10,869,807 B2
(45) Date of Patent: Dec. 22, 2020

(54) ADJUSTABLY TENSIONED ROLLER MASSAGE SYSTEM

(71) Applicant: Roll Recovery, LLC, Boulder, CO (US)

(72) Inventor: Jeremy J. Nelson, Longmont, CO (US)

(73) Assignee: Roll Recovery, LLC, Boulder, CO (US)

( * ) Notice: Subject to any disclaimer, the term of this patent is extended or adjusted under 35 U.S.C. 154(b) by 100 days.

(21) Appl. No.: 16/269,470

(22) Filed: Feb. 6, 2019

(65) Prior Publication Data

US 2020/0246214 A1 Aug. 6, 2020

(51) Int. Cl.
*A61H 15/00* (2006.01)

(52) U.S. Cl.
CPC ..... *A61H 15/0092* (2013.01); *A61H 15/00* (2013.01); *A61H 2015/0007* (2013.01); *A61H 2015/0014* (2013.01); *A61H 2015/0021* (2013.01); *A61H 2015/0028* (2013.01); *A61H 2015/0035* (2013.01); *A61H 2015/0057* (2013.01); *A61H 2201/1215* (2013.01); *A61H 2201/1253* (2013.01); *A61H 2201/1671* (2013.01)

(58) Field of Classification Search
CPC ..... A61H 7/00; A61H 7/002; A61H 7/003; A61H 7/004; A61H 7/005; A61H 7/007; A61H 2007/009; A61H 15/00; A61H 15/0078; A61H 15/0085; A61H 15/0092; A61H 2015/0007; A61H 2015/0014; A61H 2015/0021; A61H 2015/0028; A61H 2015/0035; A61H 2015/0042; A61H 2015/005; A61H 2015/0057; A61H 2201/1253; A61H 2201/1215; A61H 2201/1671
See application file for complete search history.

(56) References Cited

U.S. PATENT DOCUMENTS 1,400,547 A 12/1921 Holmstrom
1,757,060 A * 5/1930 Rieth ..... A61H 15/0092 601/125
2,219,086 A * 10/1940 Broberg ..... A61H 15/0078 601/118

(Continued)

FOREIGN PATENT DOCUMENTS

CN 2399054 10/2000
JP H11267167 10/1999

(Continued)

OTHER PUBLICATIONS

PCT International Patent Application No. PCT/US19/38046; International Search Report and Written Opinion of the International Searching Authority dated Oct. 24, 2019, 16 pages.

(Continued)

*Primary Examiner* — Colin W Stuart
(74) *Attorney, Agent, or Firm* — Craig R. Miles; CR Miles P.C.

(57) ABSTRACT

An adjustably tensioned roller massage system provides a pair of roller massage assemblies in opposed adjustable tensioned or spaced relation to allow engagement of each one of a pair of roller massage assemblies on a corresponding massageable portion of a body.

22 Claims, 8 Drawing Sheets

(56) References Cited

U.S. PATENT DOCUMENTS

| | | | | |
|---|---|---|---|---|
| 2,219,138 | A * | 10/1940 | Morrison | A61H 15/0078 601/125 |
| 3,465,750 | A | 9/1969 | Schawalder | |
| 3,583,396 | A * | 6/1971 | Landis | A61H 15/0092 601/125 |
| 3,759,250 | A | 9/1973 | Salata | |
| 5,643,182 | A | 7/1997 | Engel | |
| 5,735,803 | A | 4/1998 | Musilli | |
| 6,517,499 | B1 | 2/2003 | Pereira | |
| 6,676,580 | B2 | 1/2004 | Tsai et al. | |
| 6,974,427 | B1 | 12/2005 | Lapham | |
| D688,380 | S | 8/2013 | Nelson | |
| 2002/0165073 | A1* | 11/2002 | Tsai | A61H 15/0092 482/148 |
| 2004/0254508 | A1 | 12/2004 | Lee | |
| 2005/0203445 | A1 | 9/2005 | Tsai | |
| 2007/0173750 | A1 | 7/2007 | Hudock | |
| 2008/0103421 | A1 | 5/2008 | Nicholson | |
| 2010/0185128 | A1 | 7/2010 | Galvez Campos | |
| 2011/0137218 | A1 | 6/2011 | Collins | |
| 2013/0109546 | A1* | 5/2013 | Huang | A61H 7/003 482/115 |
| 2015/0272814 | A1 | 10/2015 | Chen | |
| 2016/0310351 | A1 | 10/2016 | Nelson | |

FOREIGN PATENT DOCUMENTS

| | | |
|---|---|---|
| JP | 2003-019173 | 1/2003 |
| JP | 2004-097459 | 4/2004 |
| JP | 2007-130327 | 5/2007 |
| WO | WO 2013/070632 | 5/2013 |

OTHER PUBLICATIONS

U.S. Appl. No. 61/628,882, filed Nov. 7, 2011.
International Patent Cooperation Treaty Patent Application No. PCT/US2012/063750, filed Nov. 6, 2012.
U.S. Appl. No. 14/350,561, filed Apr. 8, 2014.
European Patent Application No. 12848115.7; Office Action dated May 18, 2015, 7 pages total.
Dick'S Sporting Goods. Fitness Gear Leg Massager. Website, https://www.dickssportinggoods.com, originally downloaded May 14, 2018, 2 pages.
Ebay. New PTP Foot Roller from Rebel Sport. Website, http://www.ebay.com.au, originally downloaded May 15, 2017, 3 pages total.
PTP. Foot Roller—PTPfit. Website, https://www.ptpfit.com, originally downloaded May 3, 2015, 8 pages total.
Massageu Therapeutic & Fitness Products. Roleo Arm and Hand Massager. Website, https://u-selfcare.com, originally downloaded Dec. 10, 2018, 6 pages.

* cited by examiner

ADJUSTABLY TENSIONED ROLLER MASSAGE SYSTEM

I. FIELD OF THE INVENTION

An adjustably tensioned roller massage system provides a pair of roller massage assemblies in opposed adjustable tensioned or spaced relation to allow engagement of each one of a pair of roller massage assemblies on a corresponding massageable portion of a body.

II. BACKGROUND OF THE INVENTION

Conventional massage devices may provide a roller which can be drawn along the surface of the body. The amount of pressure exerted by the roller on the surface of the body depends directly on the amount of force exerted by the user on the massage device. There would be an advantage in a roller massage device and method of massaging in which roller massage device included a massage roller adjustment assembly operable to adjust the amount of force exerted by the rollers on the surface of the body.

III. SUMMARY OF THE INVENTION

Accordingly, a broad object of the invention can be to provide a massage roller adjustment assembly which operates to increase or decrease an amount of elastic force in a pair of elastic members corresponding coupled to a pair of roller assemblies which acts to resist drawing the pair of roller assemblies from a first distance apart toward a second distance apart and returns said pair of roller assemblies toward said first distance apart.

Another broad object of the invention can be to provide a massage roller adjustment assembly which operates to increase or decrease an amount of tensional force in a pair of inelastic members corresponding coupled to a pair of roller assemblies which acts to move a pair of roller assemblies from a first distance apart toward a second distance apart and returns said pair of roller assemblies toward said first distance apart.

Naturally, further objects of the invention are disclosed throughout other areas of the specification, drawings, photographs, and claims.

IV. BRIEF DESCRIPTION OF THE DRAWINGS

FIG. 12B illustrates one of a plurality of roller assemblies interchangeably disposed in one or a pair of roller massage handles.

FIG. 12C illustrates one of a plurality of roller assemblies interchangeably disposed in one or a pair of roller massage handles.

FIG. 12D illustrates one of a plurality of roller assemblies interchangeably disposed in one or a pair of roller massage handles.

FIG. 12E illustrates one of a plurality of roller assemblies interchangeably disposed in one or a pair of roller massage handles.

V. DETAILED DESCRIPTION OF THE INVENTION

Figure 1:
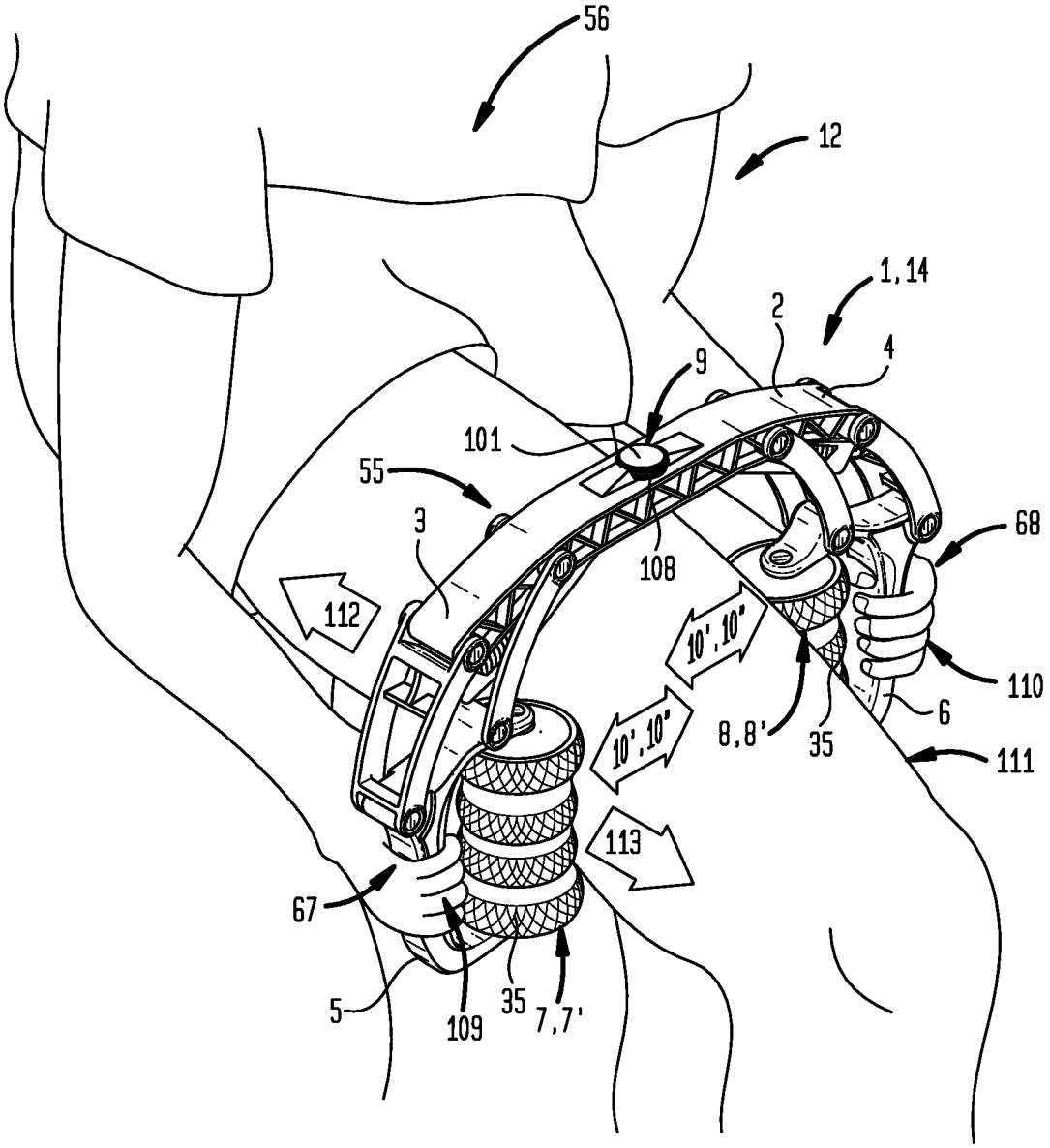
FIG. 1 is an illustration of a method of using an embodiment the inventive roller massage device.
Figure 2:
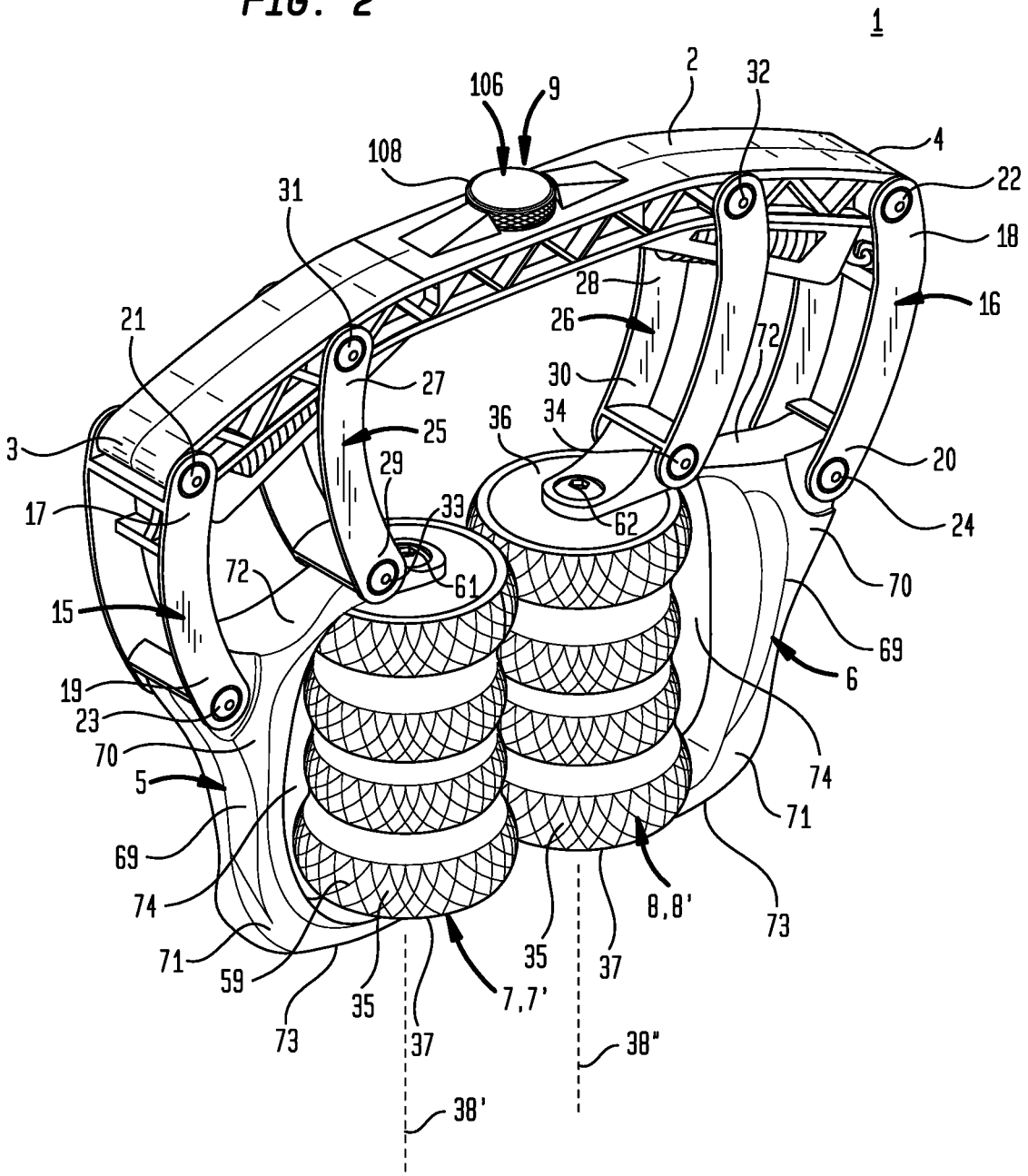
FIG. 2 is a perspective view of a particular embodiment of the inventive roller massage device.
Figure 3:
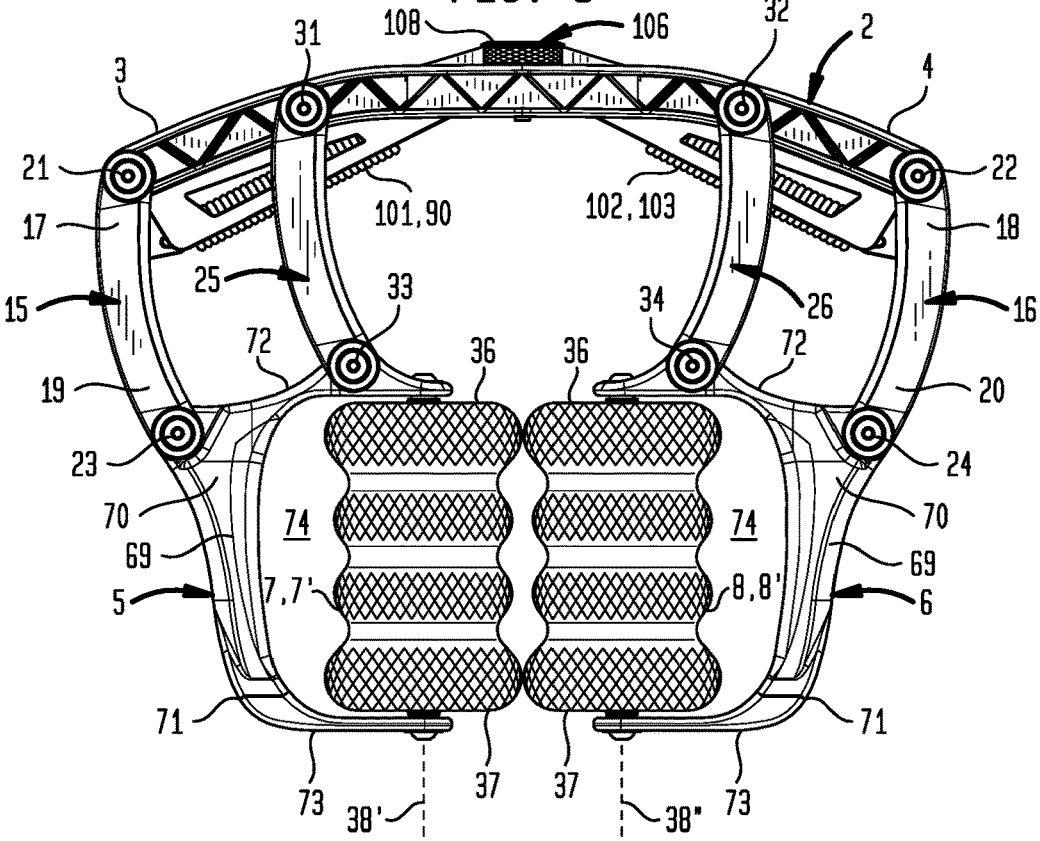
FIG. 3 is a first side elevation view of a particular embodiment the inventive roller massage device in the closed condition.
Figure 4:
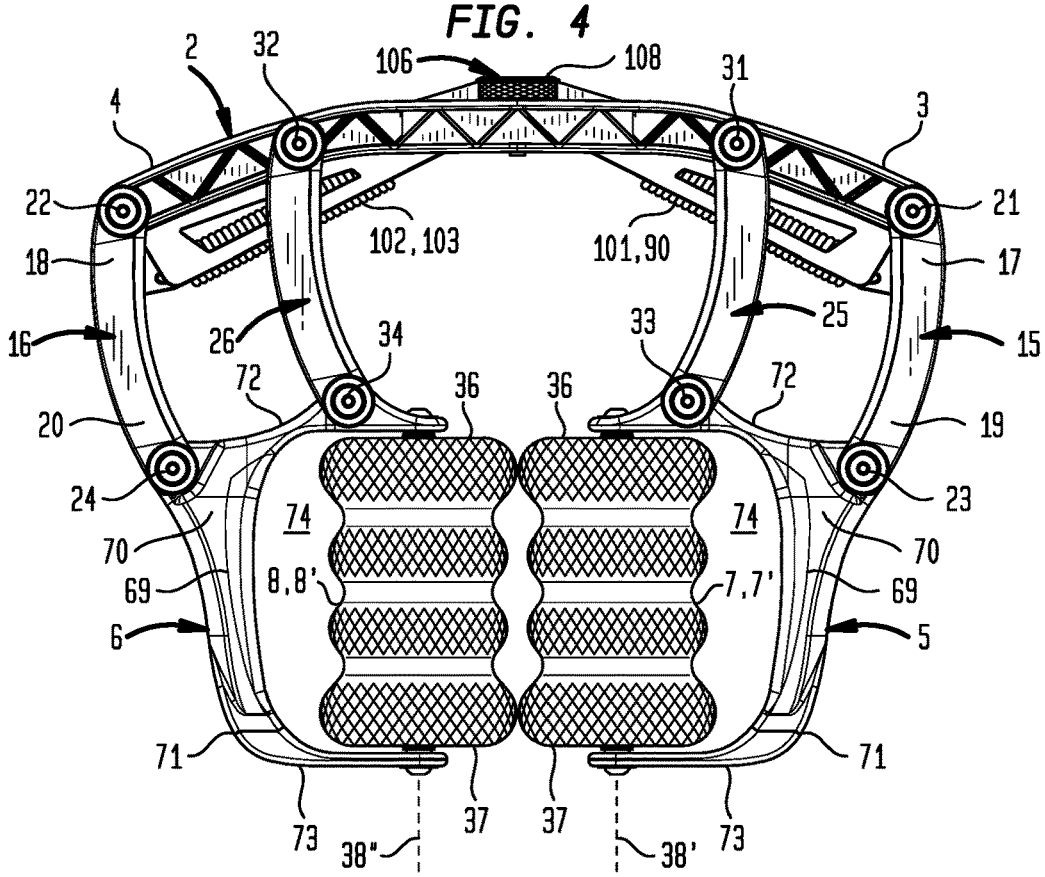
FIG. 4 is a second side elevation view of a particular embodiment of the inventive roller massage device in the open condition.
Figure 5:
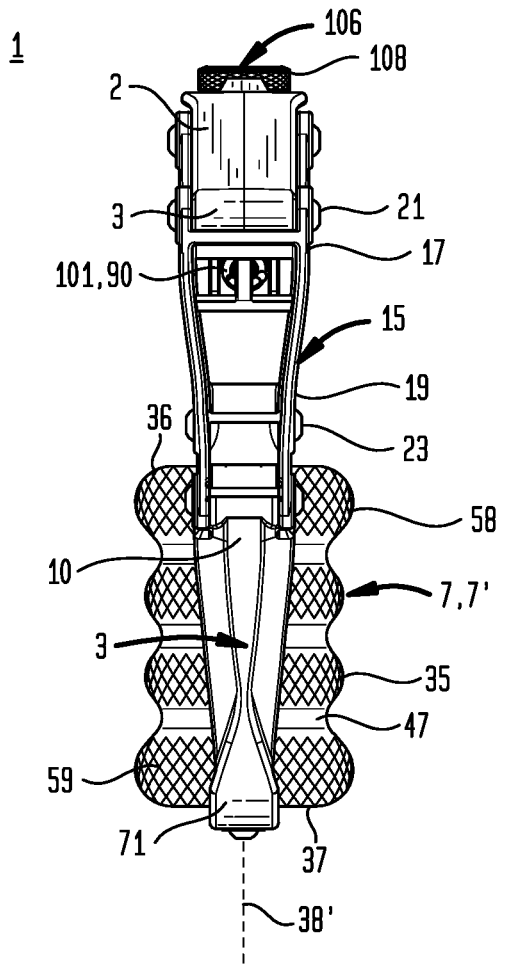
FIG. 5 is a first end view of a particular embodiment of the inventive roller massage device.
Figure 6:
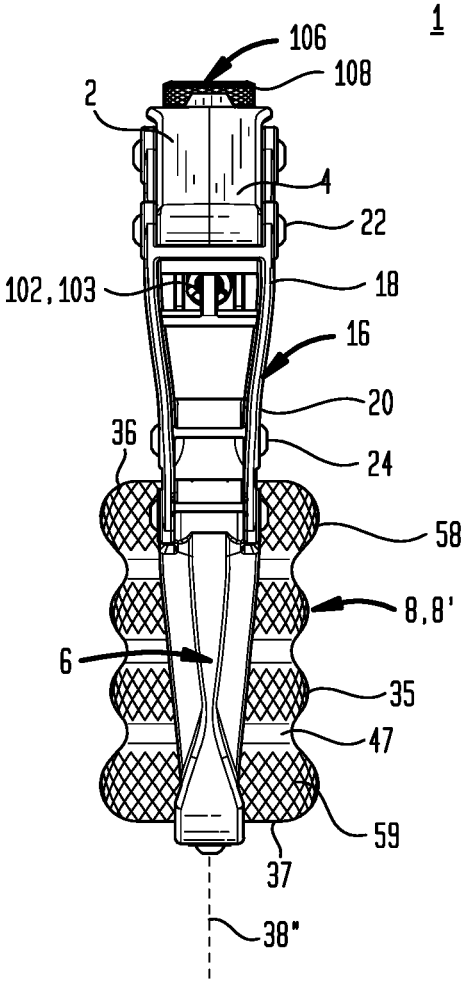
FIG. 6 is second end view of a particular embodiment of the inventive roller massage device.
Figure 7:
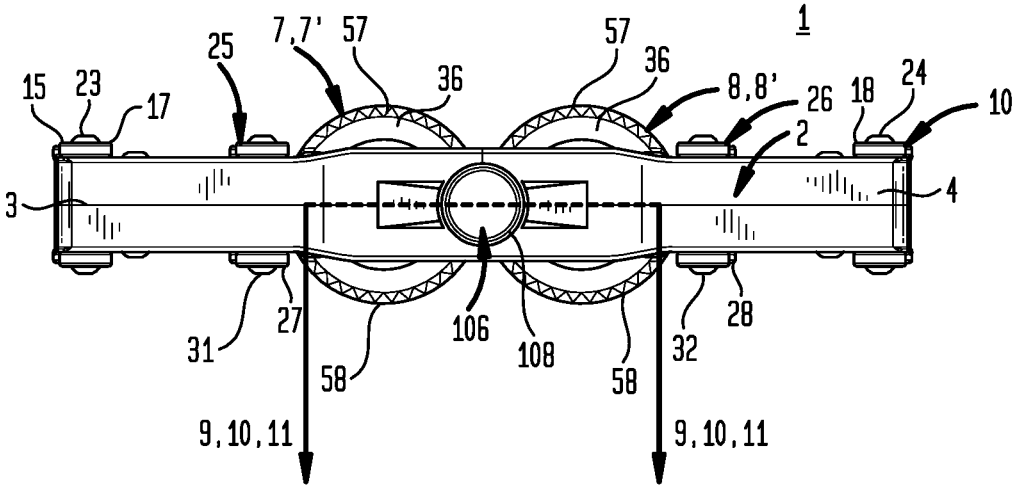
FIG. 7 is a top plan view of a particular embodiment of the inventive roller massage device.

Referring generally to FIGS. 1 through 12, which show embodiments of a roller massage device (1) including a cross member (2) having a cross member length disposed between a cross member first end (3) and a cross member second end (4). A pair of handles (5)(6) can be correspondingly coupled to the cross member first end (3) and the cross member second end (4). A pair of roller assemblies (7)(8) can be correspondingly rotatably coupled to the pair of handles (5)(6) disposing the pair of roller assemblies (7)(8) in opposed relation between the pair of handles (5)(6). A massage roller adjustment assembly (9) associated with the cross member (2) can be operably coupled to one or both of a pair of roller assemblies (7)(8).

In particular embodiments of the massage roller adjustment assembly (9), operation of the massage roller adjustment assembly (9) generates sufficient tension force (10') to increase or decrease distance between the pair roller assemblies (7)(8). The term "tension force" for the purposes of this invention means the pulling or pushing force of an inelastic member.

In other particular embodiments of the massage roller adjustment assembly (9), operation of the massage roller adjustment assembly (9) increases or decreases an amount of elastic force (10") necessary to separate or pull apart the pair of roller assemblies (7)(8). In particular embodiments of the massage roller adjustment assembly (9), operation of the massage roller adjustment assembly (9) increases or decreases an amount of elastic force (11) coupled to one or both of the pair of roller assemblies (7)(8). The term "elastic force" for the purposes of this invention means the elastic potential energy stored in an elastic member.

Now, referring primarily to FIGS. 2 through 8, the cross member (2) can take the form of a one-piece substantially inflexible cross member (2). A pair of handles (5)(6) can be correspondingly coupled proximate the cross member first end (3) and a cross member second end (4). In particular embodiments, one or both of the pair of handles (5)(6) can be pivotally coupled to the cross member first end (3) or the cross member second end (4). Rotation of one or both of the pair of handles (5)(6) in relation to the cross member (2) allows the pair of handles (5)(6) disposed in the closed condition (13) to be drawn apart under outward forcible urging by a user (12) to achieve an open condition (14) of the roller massage device (1).

Now referring primarily to FIGS. 1 through 6, in particular embodiments, the roller massage device (1) can further include a first pair of handle supports (15)(16) each having length disposed between a handle support first end (17) and a handle support second end (19). The first pair of handle supports (15)(16) can be coupled or connected by a handle support first ends (17)(18) to a corresponding one of the cross member first end (3) and the second cross member end (4) of the cross member (2). In particular embodiments, one or both of the first pair of handle supports (15)(16) can be pivotally coupled by the handle support first ends (17)(18) to a corresponding one of the cross member first end (3) or the cross member second end (4) of the cross member (2). The first pair of handle supports (15)(16) can be coupled or connected by a handle support second ends (19)(20) to a corresponding one of the pair of handles (5)(6). One or both of the first pair of handle supports (15)(16) can be pivotally coupled by a handle support second ends (19)(20) to a corresponding one of the pair of handles (5)(6). Outward forcible urging of the pair of handles (5)(6) by the user (12) toward the open condition (14) generates rotation of at least one or both of the first pair of handle supports (15)(16) about a corresponding one or pair of handle support first end pivots (21)(22). The pair of handles (5)(6) can be further rotated about one or a pair of first handle support second end pivots (23)(24) to alter the spatial relation of the pair of roller assemblies (7)(8). Embodiments which include a first pair of handle supports (15)(16) can, but need not necessarily, afford the advantage of allowing the pair of roller assemblies (7)(8) to be disposed in opposed bilateral symmetry over a greater range of travel between the closed condition (13) and the open condition (14) of the roller massage device (1).

Again, referring primarily to FIGS. 1 through 6, the roller massage device (1) can further include a second pair of handle supports (25)(26) each having length disposed between a second handle support first end (27)(28) and a second handle support second end (29)(30). Each of the second pair of handle supports (25)(26) can be coupled to the cross member (2) a distance inward of the first pair handle supports (15)(16) by the second handle support first ends (27)(28). One or both of the second handle support first ends (27)(28) can be pivotally coupled to the cross member (2) a distance inward of the first pair handle supports (15)(16) by the second handle support first ends (27)(28). Each of the second pair of handle supports (25)(26) can be coupled to the handles (5)(6) a distance inward of the first pair of handle supports (15)(16) by the second handle support second ends (29)(30). One or both of the second handle support second ends (29)(30) can be correspondingly pivotally coupled to the pair handles (5)(6) a distance inward of the first pair handle supports (15)(16) by the second handle support second ends (29)(30).

In particular embodiments, outward forcible urging of the pair of handles (5)(6) by the user (12) toward the open condition (14) generates rotation of the first pair of handle supports (15)(16) and the second pair of handle supports (25)(26) about the corresponding pairs of first and second handle support first end pivots ((21)(22)(31)(32)) and pairs of first and second handle support second end pivots (23)(24)(33)(34) allowing the pair of handles (5)(6) to be drawn apart. However, the second pair of handle supports (25)(26) limits the range of rotation of the pair of handles (5)(6) in relation to the first pair of handle supports (15)(16) to dispose the pair of roller assemblies (7)(8) in generally opposed mirror image symmetry over the entire range of travel between the closed condition (13) and the open condition (14).

Now, referring to FIGS. 2 through 8 and 12A through 12E, each of the pair of roller assemblies (7)(8) can include one or more roller elements (35) disposed between a roller first end (36) and a roller second end (37). In particular embodiments, one or both of the pair of roller assemblies (7)(8) can be provided as a one-piece roller assembly (7')(8') including only one roller element (35) or as a one-piece roller assembly including a plurality of roller elements (35). Embodiments of the one-piece roller assembly (7')(8') including a plurality of roller elements (35) can comprise a plurality of discretely formed or fabricated and subsequently interconnected plurality of roller elements (35) to provide a one-piece roller assembly (7')(8'), or a plurality of roller elements (35) can be formed or fabricated in common as a one-piece roller assembly (7')(8'). In embodiments which include a one-piece roller assembly (7')(8'), the plurality of roller elements (35) all rotate at the same rate about a roller axis (38')(38").

Now referring primarily to FIGS. 12B through 12E, in particular embodiments, the one-piece roller assembly (7')(8') can provide a roller medial portion (39) disposed between a pair of roller end portions (40)(41). In particular embodiments, as shown in the example of FIG. 12B, the roller medial portion (39) can have lesser diameter than the corresponding pair of roller end portions (40)(41). In particular embodiments, as shown in the example of FIG. 12C, the roller medial portion (39) can be configured as a convex medial portion (39') disposed between first and second concave portions (42)(43) correspondingly extending between the convex medial portion (39') and roller first and second end portions (40)(41). In particular embodiments, the convex medial portion (39') can have a convex roller medial portion maximum diameter (44) greater or lesser than the first and second end portion maximum diameters (45)(46) of the corresponding roller first and second end portions (40)(41). In particular embodiments, as shown in the example of FIG. 12D, the one-piece roller assembly (7')(8') can provide a plurality of roller elements (35) disposed in spaced apart relation between roller first and second ends (36)(37). The plurality of roller elements (35) can be correspondingly separated by a plurality of annular recesses (47) each having lesser diameter than the adjacent plurality of roller elements (35). The illustrative examples of FIGS. 12B through 12D are not intended to preclude utilization of configurations of a one-piece roller assembly (7')(8') which may only include one roller element having substantially uniform diameter between roller first and second ends (36)(37), or may include a plurality of roller elements (35)(such as 2, 3, 4, 5, 6 or more roller elements) each having the same or dissimilar roller element diameters, or a plurality of roller elements (35) disposed at similar or dissimilar distances apart.

Again, referring primarily to FIGS. 12B through 12D, in particular embodiments, each roller element (35) can further include patterned surface elements (59). The term "patterned surface element" means a pattern on the roller element (35) with at least two areas which differ in physical structure, and without sacrificing the breadth of the foregoing definition, the differences may be due to the difference in depth of the surface structure, the difference in lateral density of the surface structure, the periodicity of the surface structure, the isotropy or anisotropy of the surface structure, the direction of the anisotropy axis of the surface structure, or combinations thereof.

Figure 8:
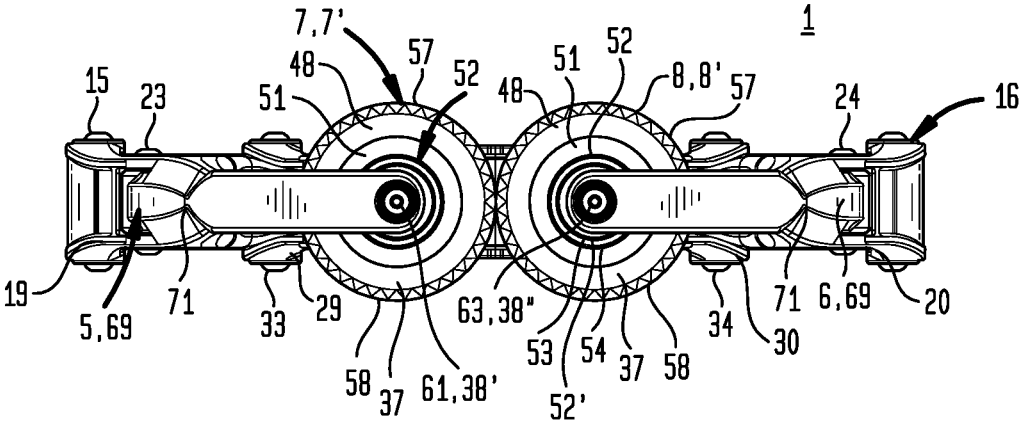
FIG. 8 is a bottom plan view of a particular embodiment of the inventive roller massage device.

Now referring primarily to FIG. 12E, in particular embodiments, each of the pair of roller assemblies (7)(8) can include a plurality of roller elements (35)(such as: two, three, four, five, six or more roller elements (35) depending upon the application). Each one of a plurality of roller elements (35) within each of the pair of roller assemblies (7)(8) can be independently rotated within the plurality of roller elements (35). Each of the one or more roller elements (35) can each be in the form of an annular member (48) which defines an outer periphery (49) and a central aperture element (50). A plurality of roller elements (35) can be disposed in adjacent abutted engagement or spaced apart relation within each of the pair of roller assemblies (7)(8). In particular embodiments, each of the one or more roller elements (35) can further include a hub element (51) which includes the central aperture element (50). The annular member (48) can be secured in fixed relation to the hub element (51) such that rotation of the hub element (51) generates a corresponding rotation in the annular member (48). The central aperture element (50) can be in the form of one or more roller element bearings (52) having a bearing inner race (53) which defines the central aperture element (50) and a bearing outer race (54) separated by bearing elements (52') (as shown in the example of FIG. 8) which assist to reduce friction in rotation of the one or more roller elements (35). The hub element (51) can be made from any substantially rigid material such as a metal, a ceramic, a plastic, a wood, or the like. Particular embodiments of the annular member (48) can also be made from a substantially rigid material, or as to other embodiments can be made from a resiliently elastic material which to an extent deforms on engagement with a massageable portion (55) of a body (56) such as a plasticized resin, a silicone rubber, a fluoropolymer, a natural or synthetic rubber, polyurethane, or the like.

Again, referring primarily to FIG. 12B through 12E, the one or more roller elements (35) can define a generally circular outer periphery (57); however, it is not intended that these illustrative examples preclude embodiments of the roller elements (35) which define a non-circular outer periphery (57) useful in massaging a massageable portion (55) of the body (56). The outer periphery (57) can, as illustrative examples, define: a circular outer periphery, an oval outer periphery, a square outer periphery, a rectangular outer periphery, a hexagonal outer periphery, heptagonal outer periphery, an octagonal outer periphery, or the like, or combinations thereof.

Now referring primarily to FIGS. 12A through 12E, in particular embodiments, each one of pair of roller assemblies (7)(8) can be removably coupled to the corresponding handle (5)(6). In the first instance, this allows replacement of a roller assembly (7)(8) with a substantially identical replacement roller assembly (7)(8). In the second instance, this allows for interchangeability between a plurality of roller assemblies (35) having dissimilar configurations of the roller external surface (58). A first roller assembly (7) or a second roller assembly (8) of the pair of roller assemblies (7)(8) can be selected from a plurality of roller assemblies (60) having different roller external surface configurations of the roller external surface (58) or different patterned surface elements (59), or combinations thereof. As an illustrative example, the plurality of roller assemblies (60) could include each of the roller assemblies shown in FIGS. 12B through 12E. The first roller assembly (7) of the pair of roller assemblies (7)(8) could be any one of the roller assembly shown in FIGS. 12B through 12E, while the second roller assembly (8) of the pair of roller assemblies (7)(8) could again be any one of the plurality of roller assemblies (60) shown in FIGS. 12B through 12E. The selected first roller assembly (7) can be interchangeably rotatably coupled to the first handle (5) and the selected second roller assembly (8) can be interchangeably rotatably coupled to the second handle (6).

Figure 12A:
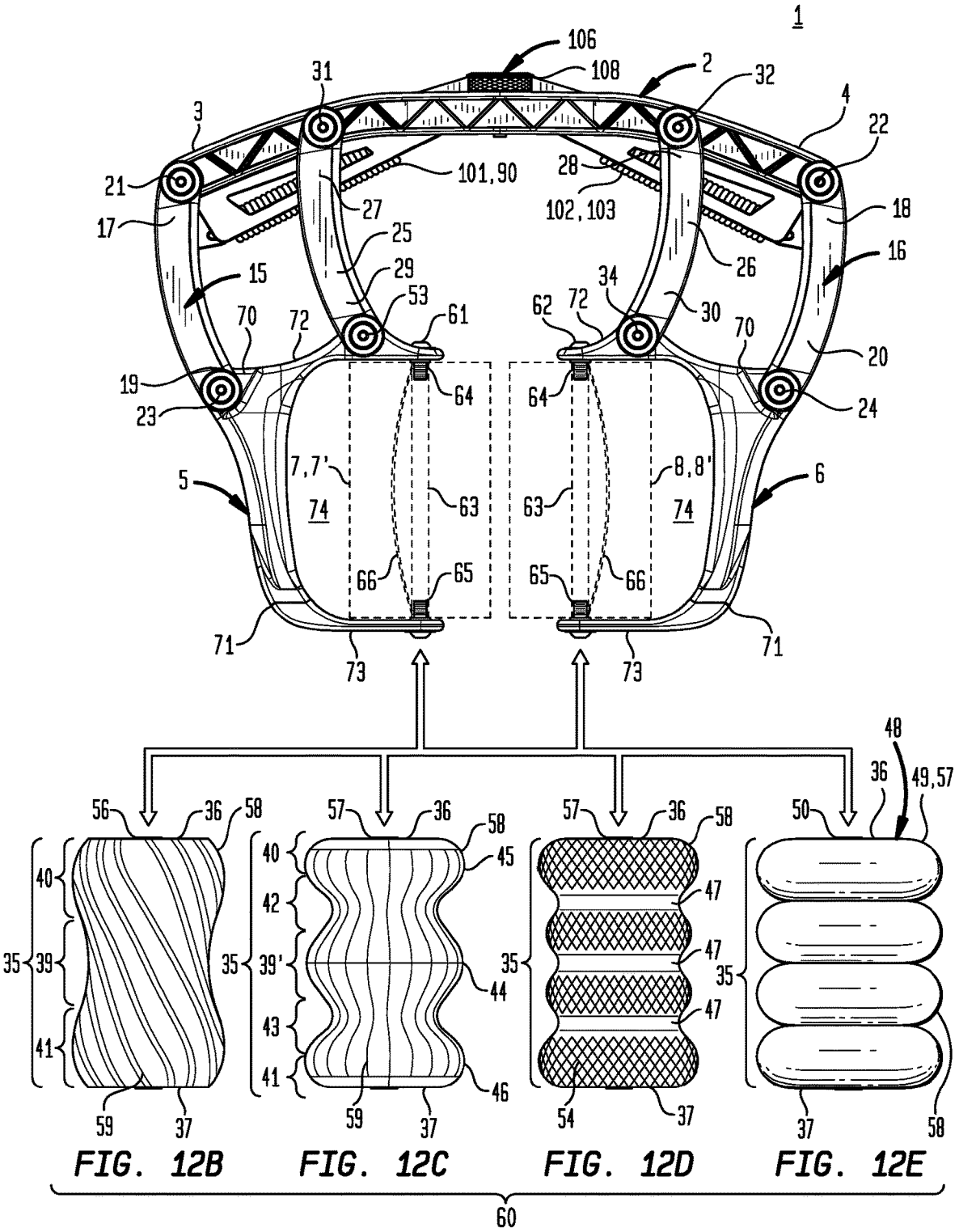
FIG. 12A illustrates a massage roller device adapted to interchangeably dispose one of a plurality of roller assemblies in one or a pair of roller massage handles.

Now, referring primarily to FIG. 12A, each one of the pair of roller assemblies (7)(8) can be correspondingly rotatably coupled to one of a pair of an axles (61)(62) corresponding supported in one of the pair of handles (5)(6). As shown in the example of FIG. 12A, each one of the pair of axles (61)(62) can include an optional axle medial portion (63) (shown in broken line) disposed between an axle first end portion (64) opposite an axle second end portion (65) supported in a corresponding handle (5)(6). The pair of axles (61)(62) can be supported in the pair handles (5)(6) at predetermined positions to correspondingly dispose the pair of roller assemblies (7)(8) in a predetermined spatial relationship. Where the pair of roller assemblies (7)(8) comprise a one-piece roller assemblies (7')(8') (as shown the examples of FIGS. 12B through 12D) only an axle first end portion (64) opposite an axle second end portion (65) may be used to allow rotatable coupling of the pair of one-piece roller assemblies (7')(8') to the corresponding pair of handles (5)(6). Where the pair of roller assemblies (7)(9) include discrete plurality of roller elements (35)(as shown in the example of FIG. 12E) each of the pair of axles (61)(62) can further include the axle medial portion (63) between first and second axle end portions (64)(65). While the pair of axles (61)(62) shown in FIG. 12A are generally linear; this is not intended to preclude embodiments in which each of the pair of axles (61)(62) can be arcuate or have an amount of curvature (66) between the opposed first and second axle end portions (64)(65)(as shown by the arcuate broken line). The amount of curvature (66) in each of the pair of axles (61)(62) can be a greater or lesser amount of curvature (66) to provide the advantage of engagement of the one or more roller elements (35) with corresponding curvature of a massageable portion (55) of a body (56).

Now referring primarily to FIGS. 1 through 4, in particular embodiments, the pair of handles (5)(6) can each configured for grippable engagement with a corresponding one of a pair of hands (67)(68) of a user (12)(as shown in the example of FIG. 1). The pair of roller assemblies (7)(8) can be made responsive at least one of pair of handles (5)(6) such that travel of at least one of the pair of handles (5)(6), or both of the handles (5)(6), results in corresponding travel of at least one of the pair of roller assemblies (7)(8) or both of the pair of roller assemblies (7)(8). As one illustrative example, each one of the pair of handles (5)(6) can include a handle grip (69) disposed between a handle first end (70) and a handle second end (71), and a pair of axle supports (72)(73) correspondingly coupled to the handle first end (70) and said handle second end (71). The pair of axle supports (72)(73) correspondingly extend from the handle first end (70) and the handle second end (71) of the handle grip (69) in generally opposed or generally parallel opposed relation to define a passthrough (74). The first and second axle end portions (64)(65) correspondingly couple to the pair of axle supports (72)(73) to dispose a corresponding one of the pairs of roller assemblies (7)(8) within the passthrough (74). The passthrough (74) can further provide sufficient open space between the outer periphery (57) of the one or more roller elements (35) of the corresponding one of the pair of roller assemblies (7)(8) and the corresponding one of the pair of handles (5)(6) to allow one of the pair of hands (67)(68) of the user (12) to grippingly engage the handle grip (69) of one of the pair of handles (5)(6) without engaging the outer periphery (57) of the corresponding one of the pair of roller assemblies (7)(8).

Figure 9:
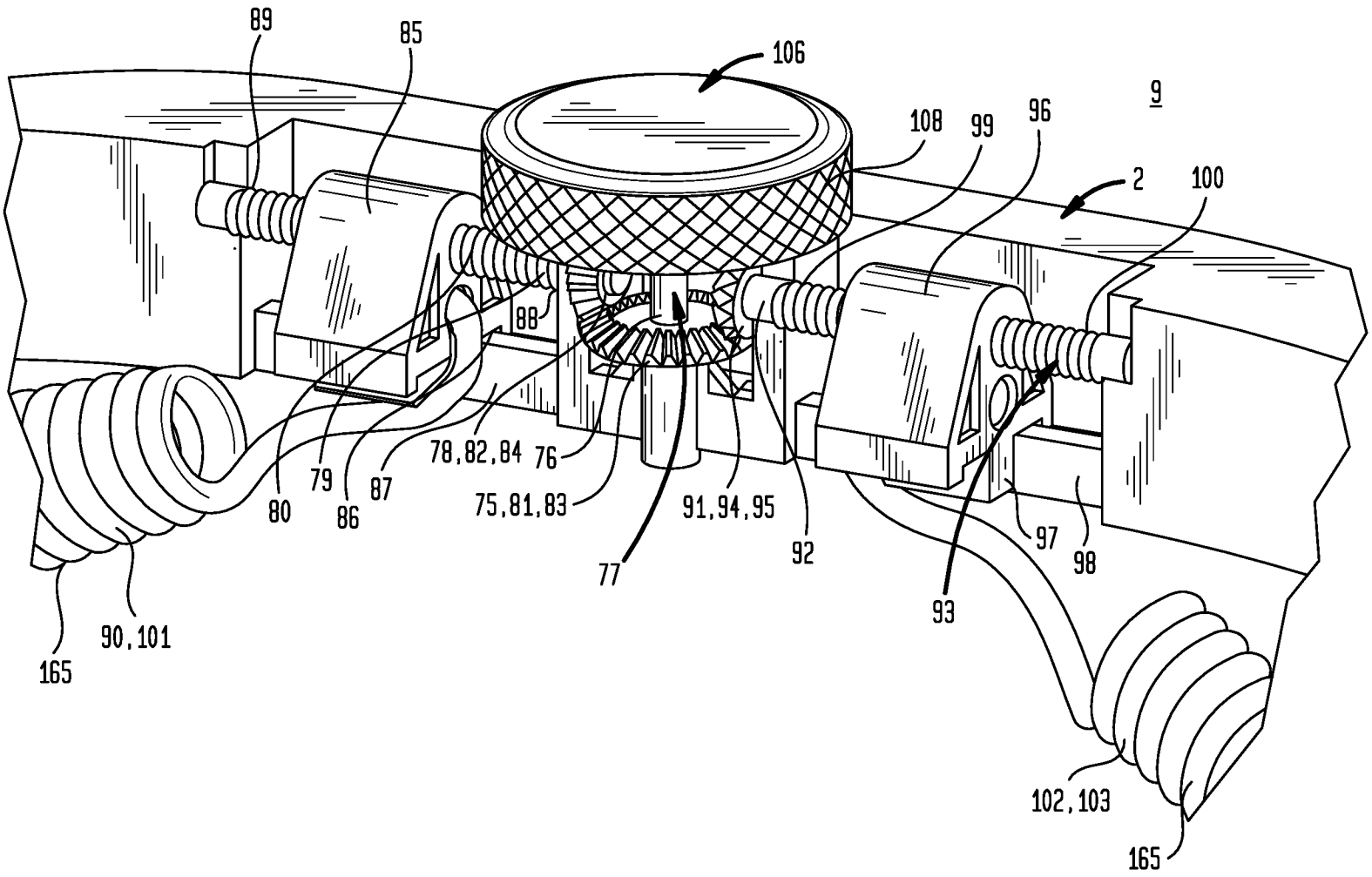
FIG. 9 is an enlarged cross section view 9-9 as shown in FIG. 7 which illustrates an embodiment of a massage roller adjustment assembly.
Figure 10:
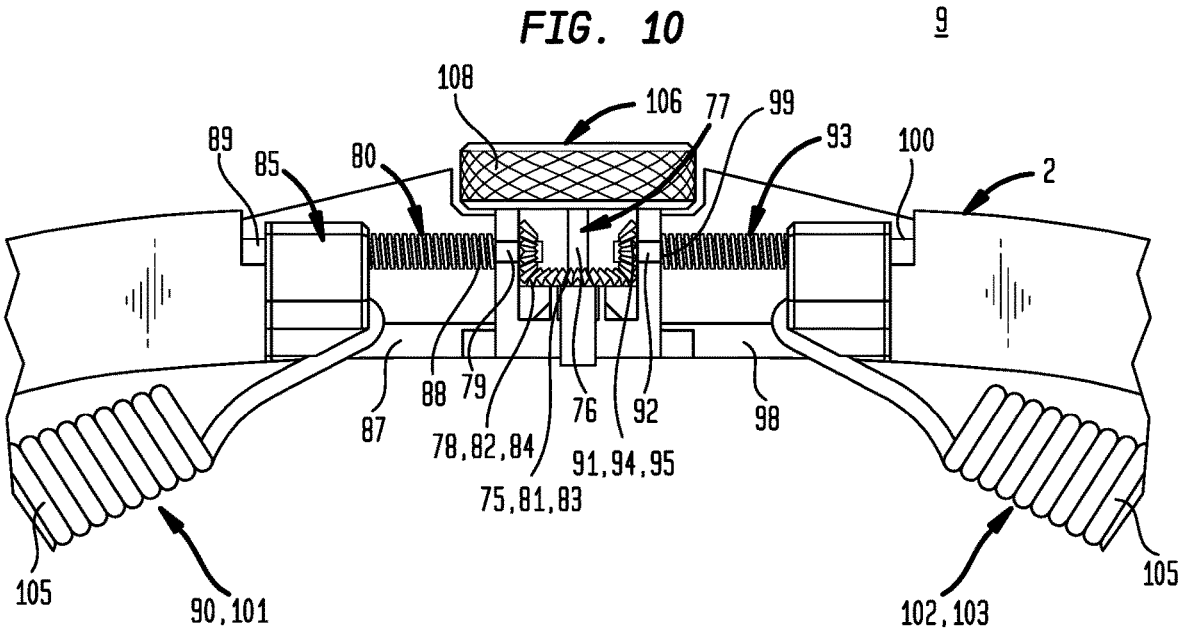
FIG. 10 is a cross section view 10-10 as shown in FIG. 7 which illustrates the embodiment of the massage roller adjustment assembly shown in FIG. 9 at a first end of the adjustment range.
Figure 11:
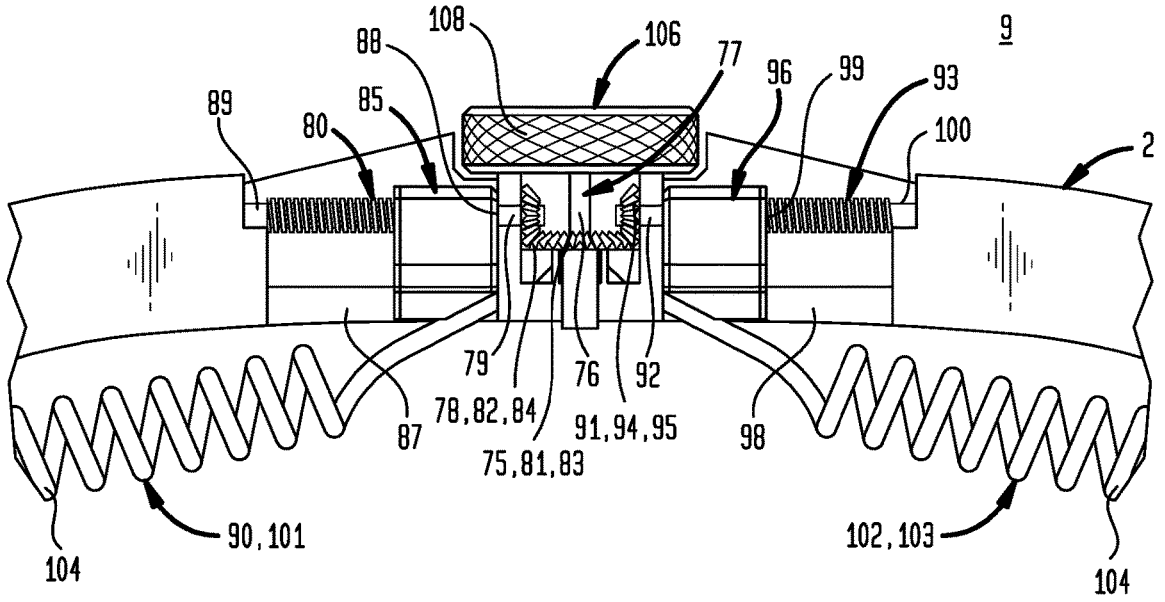
FIG. 11 is a cross section view 11-11 as shown in FIG. 7 which illustrates the embodiment of the massage roller adjustment assembly shown in FIG. 9 at a second end of the adjustment range.

Now referring primarily to FIGS. 9 through 11, in particular embodiments the roller massage device (1) can further include a massage roller adjustment assembly (9) supported within the cross member (2). The massage roller adjustment assembly (9) can include a drive member (75) affixed to a first end portion (76) of a drive shaft (77) rotationally supported in said cross member (2). A first driven member (78) affixed to a first end portion (79) of a first threaded shaft (80) can be rotationally supported in the crossmember (2) generally orthogonal to the drive shaft (77). The drive member (75) can rotationally engage the first driven member (78) to correspondingly rotate the first threaded shaft (80). In the embodiment of the massage roller adjustment assembly (9) shown in the Figures, the drive member (75) and the first driven member (78) can be bevel gears (81)(82) where the axes of the drive shaft (77) and the first threaded shaft (80) intersect and the tooth-bearing faces (83)(84) of the bevel gears (81)(82) can be conically shaped to allow meshed engagement of the tooth bearing faces (83)(84). While the drive shaft (77) and the first threaded shaft (80) can be disposed at about 90 degrees apart, the bevel gears (81)(82) can be structured for meshed engagement at other angles as well.

Again, referring primarily to FIGS. 9 through 11, a first follower (85) can be threadingly engaged on the first threaded shaft (80). The first follower (85) can further include a first follower guide channel (86) slidingly engaged to a first follower guide (87) supported within the cross member (2). The first follower (85) can move axially along the first threaded shaft (80) by rotation of the first threaded shaft (80) while sliding engagement of the first follower guide channel (86) occurs along the first follower guide (87) to limit rotation of the first follower (85) around the first threaded shaft (80). The first follower (85) can move along the first threaded shaft (80) between opposite first threaded shaft first and second ends (88)(89).

Now referring primarily to FIGS. 10 and 11, in particular embodiments, the first roller assembly (7) can be coupled to the first follower (85), whereby movement of the first follower (85) along the first threaded shaft (80) generates movement of the first roller assembly (7), which in particular embodiments can increase or decrease distance between the pair of roller assemblies (7)(8).

Again, referring primarily to FIGS. 10 and 11, in particular embodiments, the first roller assembly (7) can be coupled to the first follower (85) by one or more first elastic element (90). The first elastic element (90) can comprise or be selected from the group consisting of an elastic member, elastic cord, elastic bands, springing element, extension spring, coil spring, or the like, which when disposed in the stretched condition (104) exerts a restoring force which tends to return the elastic element (90) to the original unstretched condition (105). In these particular embodiments, movement of the first follower (85) along the first threaded shaft (80) toward a threaded shaft first end (88) (as shown in the example of FIG. 11) longitudinally extends the one or more elastic elements (90) thereby increasing tension of the one or more elastic elements (90). As shown in the example of FIG. 10, movement of the first follower (85) along the first threaded shaft (80) toward the first threaded shaft second end (89) allows the one or more elastic elements (90) to retract toward the unstretched condition (105), thereby decreasing tension of the one or more elastic elements (90).

Again, referring primarily to FIGS. 9 through 11, in particular embodiments the roller massage device (1), the massage roller adjustment assembly (9) supported within the cross member (2), can further include a second driven member (91) affixed to a first end portion (92) of a second threaded shaft (93) rotationally supported in the crossmember (2) generally orthogonal to the drive shaft (77). The drive member (75) can rotationally engage the second driven member (91) to correspondingly rotate the second threaded shaft (93). In the embodiment of the massage roller adjustment assembly (9) shown in the Figures, the drive member (75) and the second driven member (91) can be bevel gears (81)(94) where the axes of the drive shaft (77) and the second threaded shaft (93) intersect and the tooth-bearing faces (83)(95) of the bevel gears (81)(94) can be conically shaped to allow meshed engagement of the tooth bearing faces (83)(95). While the drive shaft (77) and the second threaded shaft (93) can be disposed about 90 degrees apart, the bevel gears (81)(94) can be structured for meshed engagement at other angles as well.

Again, referring primarily to FIGS. 9 through 11, a second follower (96) can be threadingly engaged on the second threaded shaft (93). The second follower (96) can further include a second follower guide channel (97) slidingly engaged to a second follower guide (98) supported within the cross member (2). The second follower (96) can move axially along the second threaded shaft (93) by rotation of said second threaded shaft (93) while sliding engagement of the second follower guide channel (97) occurs along the second follower guide (98) to limit rotation of the second follower (96) around the second threaded shaft (93). The second follower (96) can move along the second threaded shaft (93) between opposite second threaded shaft first and second ends (99)(100).

Again, referring primarily to FIGS. 10 and 11, in particular embodiments, the first roller assembly (7) can be coupled to the first follower (85) and the second roller assembly (8) can be coupled to the second follower (96), whereby movement of the first follower (85) along the first threaded shaft (80) generates movement of the first roller assembly (7), and whereby movement of the second follower (96) along the second treaded shaft (93) generates movement of the second roller assembly (8), thereby increasing or decreasing distance between the pair of roller assemblies (7)(8).

Again, referring primarily to FIGS. 10 and 11, in particular embodiments, the first follower (85) and first of the first pair of handle supports (15) can be connected by a first inelastic coupling (101) responsive to movement of the first follower (85) along the first threaded shaft (80) and second follower (96) and a second of the first pair of handle supports (16) can be connected by a second inelastic coupling (102) responsive to movement of the second follower (96) along the second threaded shaft (93), whereby movement of the first and second followers (85)(96) correspondingly generate corresponding movement in the first pair of handle supports (15)(16) which correspondingly generates movement in the corresponding pair of roller assemblies (7)(8).

Again, referring primarily to FIGS. 10 and 11, in particular embodiments, the first roller assembly (7) can be coupled to the first follower (85) by the first elastic element (90) and the second roller assembly (8) can be coupled to the second follower (96) by a second elastic element (103). The first and second elastic elements (90)(103) can comprise or be selected from the group consisting of an elastic member, elastic cord, elastic bands, springing element, extension spring, coil spring, or the like, which when disposed in the stretched condition (104) exerts a restoring force which tends to return the first and second elastic element (90)(103) toward the original unstretched condition (105). In these particular embodiments, movement of the first follower (85) along the first threaded shaft (80) toward the first threaded shaft first end (88) (as shown in the example of FIG. 11) and movement of the second follower (96) along the second threaded shaft (93) toward the second threaded shaft first end (99) longitudinally extends the first and second elastic elements (90)(103) thereby increasing tension of the first and second elastic elements (90)(103). As shown in the example of FIG. 10, movement of the first follower (85) along the first threaded shaft (80) toward the first threaded shaft second end (89) and movement of the second follower (96) along the second threaded shaft (93) toward the second threaded shaft second end (100) allows the first and second elastic elements (90)(103) to retract, thereby decreasing tension of the first and second elastic elements (90)(103).

Now, referring primarily to FIGS. 9 through 11, in particular embodiments, the massage roller adjustment assembly (9) can further include an adjustment knob (106) affixed to a drive shaft second end portion (107) of the drive shaft (77) and extending outward of the cross member (2). Depending on the embodiment, the adjustment knob (106) can be rotated in the clockwise or counter clockwise direction to operate the massage roller adjustment assembly (9) to move only the first roller assembly (7) or only the second roller assembly (8) in relation to the other, or concurrently move both the first and second roller assemblies (7)(9) in relation to each other, whereby the roller massage device (1) can be adjusted to move the first and second roller assemblies (7)(8) between the closed condition (13) and the open condition (14) of the roller massage device (1).

Again, referring primarily to FIG. 1, in particular embodiments, the adjustment knob (106) can be rotated in the clockwise or counter clockwise direction to operate the massage roller adjustment assembly (9) to increase tension of the first and second elastic elements (90)(103) which increases the amount of force (10) that must be applied to the first handle (5) and the second handle (6) to move the first roller assembly (7) away from the second roller assembly (8), and correspondingly increases the amount of force (10) applied by the first and second roller assemblies (7)(8) to a massageable portion (55) of a body (56). Correspondingly, the adjustment knob (106) can be rotated in the clockwise or counter clockwise direction to operate the massage roller adjustment assembly (9) to decrease tensional force stored in the first and second elastic elements (90)(103) which decreases the amount of force (10) that must be applied to the first handle (5) to move the first roller assembly (7) away from the second roller assembly (8) and correspondingly decreases the amount of force (10) applied by the first and second roller assemblies (7)(8) engaged to a massageable portion (55) of a body (56).

Embodiments of the adjustment knob (106) can have an adjustment knob external surface (108) configured to be gripped by the fingers (109)(110) of the human hand (67)(68); and while the Figures show the adjustment knob (106) as being generally cylindrical; this is not intended to preclude the adjustment knob (106) external surface from being configured in any manner that allows affixation to the drive shaft second end portion (107) and rotation to operate the massage roller adjustment assembly (9).

Now referring primarily to the FIG. 1, the massageable portion (55) of the body (56) can be generally tubular, such as the upper portion of a leg (111). Particular embodiments of the roller assemblies (7)(8) can be selected from plurality of roller assemblies (60) and rotatably coupled or interchangeably rotatably coupled to the corresponding pair of handles (5)(6) to allow a plurality of roller elements (35) to more closely conform, engage, or treat the corresponding curvature of the massageable portion (55) of the body (56).

Again, referring primarily to FIGS. 1 through 12, a method of massage using embodiments of the roller massage device (1) can include one or more of grippingly engage a pair of handles (5)(6) with a pair of hands (67)(68). The pair of handles (5)(6) in the closed condition (13) of the roller massage device (1) can be drawn a distance outward toward the open condition (14) to correspondingly dispose the pair of roller assemblies (7)(8) a distance apart. The user (12) can allow the pair of handles (5)(6) to return toward the closed condition (13) to engage the pair of roller massage assemblies (7)(8) on a massageable portion (55) of the body (56). The user (12) can generate travel in the pair of roller assemblies (7)(8) by forcibly urging on each of the pair of handles (5)(6) in a first direction (112) on the massageable portion (55) of the body (56). The user (12) can forcibly urge each of the pair of handles (5)(6) in a second direction (113) to correspondingly generate travel in the pair of roller massage assemblies (7)(8) on the massageable portion (55) of the body (56) in the second direction (113).

In particular embodiments, the method can further include operating a massage roller adjustment assembly (9) to rotate a drive shaft (77) rotationally supported in the cross member (2) to generate corresponding rotation in a first drive member (75) affixed to the first end portion (79) of the drive shaft (77) and corresponding rotation of a first or second driven member (78)(91) (or both) affixed to a first end portion (79)(92) of corresponding first or second threaded shafts (80)(93) rotationally supported in the crossmember (2) generally orthogonal to the drive shaft (77). The method can further include correspondingly moving a first or second follower (85)(96)(or both) along the first or second threaded shafts (80)(93) by rotation of the first or second threaded shafts (80)(93), and correspondingly adjusting tension of a first or second elastic element (90)(103)(or both) correspondingly coupled between the first and second followers (85)(96) and the first and second roller assemblies (7)(8).

While the illustrative example of FIG. 1 shows the massageable portion (55) of the body (56) as the upper portion of a leg (110) of a user (12); the example is not intended to preclude use of the roller massage device (1) on any other portion of the body (55) which can be engaged by travel of the pair of roller massage assemblies (7)(8), such as the lower leg, upper arm, lower arm, upper body, lower body, buttocks, hands, feet, or the like. Additionally, while the roller massage device (1) is shown massaging a portion of a body (56) of a user (12), the example is not intended to preclude use of the roller massage device (1) on a massageable portion (55) of the body (56) of other animals, such as cattle, horses, dogs, cats, or the like. Moreover, while the example of FIG. 1 shows the user (12) of the roller massage device (1) massaging the user's own massageable portion (55) of the body (56); the example is not intended to preclude the user (12) of the roller massage device (1) from being separate from, independent of or discrete from the massageable portion (55) of the body (56).

As can be easily understood from the foregoing, the basic concepts of the present invention may be embodied in a variety of ways. The invention involves numerous and varied embodiments of a massage roller adjustment assembly (9) which can be implemented in a numerous and wide variety of roller massage devices (1) and methods for making and using such massage roller adjustment assembly (9) in embodiments of the roller massage device (1) including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "roller" should be understood to encompass disclosure of the act of "rolling"—whether explicitly discussed or not—and, conversely, were there effectively disclosure of the act of "rolling", such a disclosure should be understood to encompass disclosure of a "roller" or even a "means for rolling." Such alternative terms for each element or step are to be understood to be explicitly included in the description.

In addition, as to each term used, it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the massage roller devices and massage roller adjustment assemblies herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

What is claimed is:

1. An apparatus, comprising:

a cross member having a first end opposite a second end;

a drive member affixed to a first end portion of a drive shaft rotationally supported in said cross member;

a first driven member affixed to a first end portion of a first threaded shaft rotationally supported in said cross member orthogonal to said drive shaft, said drive member rotationally engaged to first driven member to rotate said first threaded shaft;

a first follower threadingly engaged on said first threaded shaft, said first follower movable along said first threaded shaft by rotation of said first threaded shaft between a first threaded shaft first end and a first threaded shaft second end;

a first handle coupled to said cross member first end; and a first elastic member or a first inelastic member coupled between said first follower and said first handle; said first elastic member or said first inelastic member responsive to movement of said first follower along said first threaded shaft.

2. The apparatus of claim 1, further comprising wherein movement of said first follower along said first threaded shaft between a first threaded shaft first end and a first threaded shaft second end increases or decreases elastic force in said first elastic member.

3. The apparatus of claim 1, further comprising wherein movement of said first follower along said first threaded shaft between a first threaded shaft first end and a first threaded shaft second end generates tension force in said first inelastic member sufficient to move said first handle.

4. The apparatus of any one of claim 2 or 3, further comprising a first roller assembly rotatably coupled to said first handle.

5. The apparatus of claim 1, further comprising:

a second driven member affixed to a first end portion of a second threaded shaft rotationally supported in said cross member orthogonal to said drive shaft, said drive member rotationally engaged to said second driven member to rotate said second threaded shaft;

a second follower threadingly engaged on said second threaded shaft, said second follower movable along said second threaded shaft by rotation of said second threaded shaft between a second threaded shaft first end and a second threaded shaft second end;

a second handle coupled to said cross member second end; and a second elastic member or a second inelastic member coupled between said second follower and said second handle, said second elastic member or said second inelastic member responsive to movement of said second follower along said second threaded shaft.

6. The apparatus of claim 5, further comprising wherein movement of said second follower along said second threaded shaft between a second threaded shaft first end and a second threaded shaft second end increases or decreases elastic force in said second elastic member.

7. The apparatus of claim 5, further comprising wherein movement of said second follower along said second threaded shaft between a second threaded shaft first end and a second threaded shaft second end generates tension force in said second inelastic member sufficient to move said second handle.

8. The apparatus of any one of claim 6 or 7, further comprising a first roller assembly rotatably coupled to said first handle and a second roller assembly rotatably coupled to said second handle.

9. The apparatus of claim 8, further comprising a first pair of handle supports each having a first handle support first end opposite a first handle support second end, said first handle support first ends correspondingly pivotally mounted proximate said cross member first end and said cross member second end, first handle support second ends correspondingly pivotally mounted to said first handle and said second handle.

10. The apparatus of claim 9, further comprising a second pair of handle supports each having a second handle support first end opposite a second handle support second end, said second handle support first ends correspondingly pivotally mounted to said cross member a distance inward of said first handle support first ends pivotally mounted proximate said cross member first end and said cross member second end, said second handle support second ends correspondingly pivotally mounted to said first handle and said second handle a distance inward of said first handle support second ends correspondingly pivotally mounted to said first handle and said second handle.

11. The apparatus of claim 9, wherein said first elastic member or said first inelastic member coupled between said first follower and said first one of said pair of first handle supports, and wherein said second elastic member or said second inelastic member coupled between said second follower and said second one of said pair of first handle supports.

12. The apparatus of claim 5, wherein said drive member comprise a drive gear, and wherein said first and second driven members each comprise a driven gear, said drive gear rotatingly meshes with said first and second driven gears.

13. The apparatus of claim 5, wherein said first roller assembly comprises one of a plurality of roller assemblies, each of said plurality of roller assemblies configured to interchangeable rotatably couple to said first handle.

14. The apparatus of claim 13, wherein said second roller assembly comprises one of a plurality of roller assemblies, each of said plurality of roller assemblies configured to interchangeably rotatably couple to said second handle.

15. The apparatus of claim 14, wherein a first one of said plurality of roller assemblies has an external surface configuration the same as a second one of said plurality of roller assemblies.

16. The apparatus of claim 14, wherein a first one of said plurality of roller assemblies has an external surface configuration different than a second one of said plurality of roller assemblies.

17. The apparatus of claim 5, further comprising an adjustment knob external to said cross member, said adjustment knob affixed to a second end portion of said drive shaft.

18. The apparatus of claim 17, wherein said adjustment knob rotatable to concurrently move a first roller and a second roller.

19. The apparatus of 19, wherein said adjustment knob rotatable to concurrently increase or decrease elastic force in said first elastic member and said second elastic member.

20. The apparatus of claim 1, further comprising an adjustment knob external to said cross member, said adjustment knob affixed to a second end portion of said drive shaft.

21. The apparatus of claim 20, wherein said adjustment knob rotatable to move a first roller.

22. The apparatus of claim 20, wherein said adjustment knob rotatable to increase or decrease elastic force in said first elastic member.

* * * * *